United States Patent [19]

Krulwich

[11] 4,024,662

[45] May 24, 1977

[54] COPYHOLDER AND LINE FOLLOWER

[76] Inventor: Lester S. Krulwich, 241 Central Park West, New York, N.Y. 10024

[22] Filed: Dec. 8, 1975

[21] Appl. No.: 638,826

[52] U.S. Cl. ..... 40/352

[51] Int. Cl.[2] ..... B41J 11/14

[58] Field of Search ..... 40/349, 352, 353

[56] References Cited

UNITED STATES PATENTS

| | | | |
|---|---|---|---|
| 176,088 | 4/1876 | Stapler | 40/352 |
| 2,331,149 | 10/1943 | Van Buren | 40/349 |
| 2,541,513 | 2/1951 | Hassett | 40/352 |
| 2,763,241 | 9/1956 | Waggoner | 40/352 |
| 2,965,978 | 12/1960 | Olson | 40/142 AX |
| 3,089,464 | 5/1963 | Mendels | 40/352 |
| 3,153,400 | 10/1964 | Mendels | 40/352 |

*Primary Examiner*—Russell R. Kinsey
*Assistant Examiner*—Wenceslao J. Contreras

[57] ABSTRACT

A copyholder and line follower in the form of a backing with a manually movable rod having magnetic end members and adjustable magnetically attractable side facings on elongated extensions with channels. The backing is provided with an adjustable easel and a top clamp with a magnetic spring or opposite and repelling poles.

4 Claims, 6 Drawing Figures

COPYHOLDER AND LINE FOLLOWER

This invention relates to a device for holding copy and following lines while typing and for other appropriate uses. Devices presently available are unnecessarily complicated and expensive, too likely to get out of order, not readily usable and fail to fill the needs of the user.

An important object of this invention is to provide an improved apparatus with which to hold copy and follow lines by a flip of the fingers without complicated mechanisms.

Another object of this invention is to provide an improved copyholder and line follower device that is inexpensive to make and unlikely to get out of order.

Another object of this invention is to provide an improved copyholder and line follower device suitable for copy of various thicknesses as well as sizes such as steno books and books of many other sizes.

Further objects and structural details of the invention will be apparent from the following description when read in conjunction with accompanying drawings forming a part of this specification, wherein.

Figure 1:
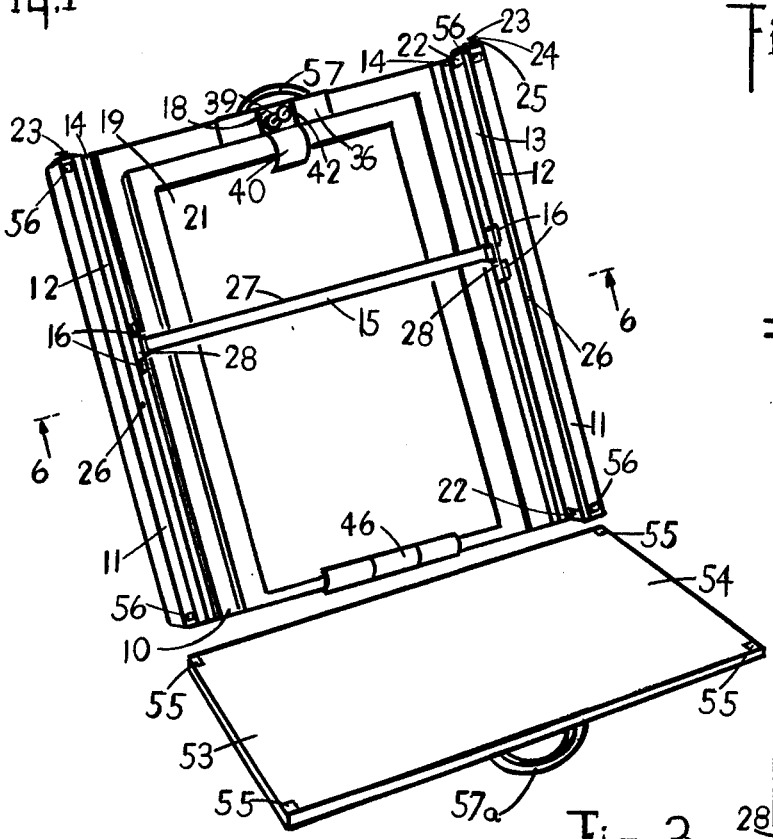
FIG. 1 is a perspective view of an emnbodiment of my invention with a top magnetic clamp and an enclosure cover.
Figure 2:
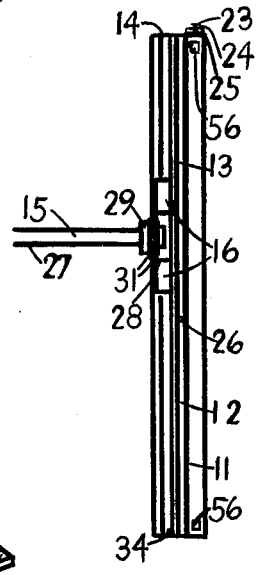
FIG. 2 is an enlarged top view of one side of the rod with the magnets, the support member and other parts of that side.
Figure 3:
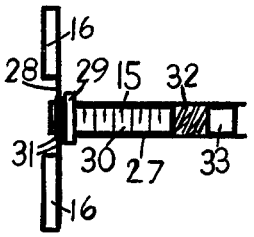
FIG. 3 is an enlarged top view of end members of the rod showing optional portions of the inside of the rod.
Figure 4:
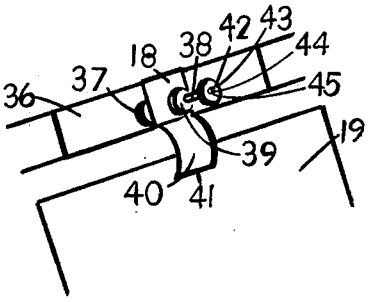
FIG. 4 is a perspective view of the top magnetic clamp device.
Figure 5:
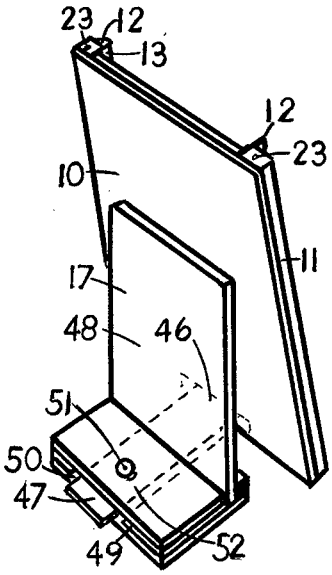
FIG. 5 is a perspective view of the backing and some of its attachments with an optional embodiment of the adjustable easel.
Figure 6:
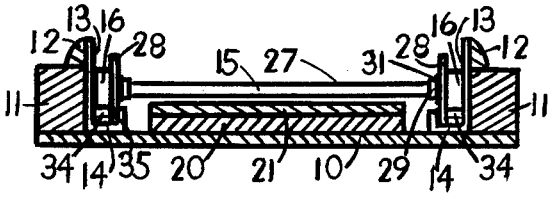
FIG. 6 is an enlarged section on line 6—6 of FIG. 1.

Upon reference to the drawings in detail, they show a copyholder and line follower apparatus comprising a backing 10, elongated, lateral side extensions 11 on which are movably mounted strips 12 to which facings 13 are attached, channels 14 formed with the bottom of the facing 13, a rotatable rod 15 with end magnets 16, an adjustable easel 17 and a magnetic top clamp 18.

The backing 10 shown in FIG. 1 and other views is of relatively thin, lightweight, rigid material such as one-eighth inch plywood or plastic, preferably rectangular for example 11 by 12 inches to readily accommodate copy 19 such as standard stationery, legal sheets and stenographer books. The backing 10 is preferably centrally covered, by suitable means, with a resilient cushioning 20 such as foam rubber and on this a more firm covering 21 with a friction engaging surface on top such as thin masonite with the ribbed side on top.

The backing 10 has parallel extensions 11, for example ½ inch wide and ¾ inch high, extending longitudinally approximately adjacent to each of its lateral sides with walls toward the inside and at right angles to the backing 10. Optionally each extension 11 has a strip 12 mounted on top preferably capable of being raised by suitable means from the extension 11. Facings 13 of magnetically attractable material such as sheet iron are preferably removably set against the walls of the extensions 11 and are attached on top to the strips 12. An optional means of raising the strips 12, with the attached facings 13, is with one end of angles 22 being fastened to the facings 13 and the other end of the angles 22 movably set against the outside of the extensions 11. This other end may be provided with thumb set screws 23 that can be turned in threaded holes 24 against outside top ends of the extensions 11, said ends being preferably covered with resilient material 25 such as rubber. A post 26 may then be inserted downwardly and spaced away, from the top of each strip 12 into the extensions 11 removably for leveling. Optionally any of these parts may be permanently or integrally fastened to each other.

A manually movable rod 15 is provided of an overall length, including end parts, whereby its ends engage the facings 13. The rod 15 is preferably cylindrical and optionally tubular, and may be contained in resilient tubing 27 or coated with resilient material. The rod 15 is preferably rotatable and when manually moved frictionally engages the sheet or other copy 19 on the backing 10.

The rod 15 is preferably provided with magnets 16 for example ½ inch diameter and ⅛ inch thick, on each end so that they movably adhere to the magnetically attractable facings 13. On each end of the rod 15 two magnets 16 are preferably mounted by suitable means on opposite ends of a somewhat elongated, flat support member 28 which is separately rotatable on the rod 15, for example between a spaced nut 29 and bolt 30 with washers 31, with the bolt 30 extending into and fastened in the tubular rod 15.

The rod 15 may optionally contain a spring 32 toward each end cooperatively or independently propelling the bolts 30 or other end members of the rod 15 to engage the facings 13. The springs 32 may be on the outside of the rod 15 but are preferably contained in the tubular rod 15 with one end attached to a holding block 33 and the other to the inner end of the bolt 30. Suitable flanges and collars may be included and either or both the spring 32 and bolt 30 may extend through the rod 15.

Channels 14 are optionally formed, integrally or otherwise, with the bottom of the facings 13, by narrow flat strips 34, of magnetically attractable material such as sheet iron, extending outwardly from the facings 13 on the backing 10. The height of the strips 34 are raised to about the same width as the bottom of the magnets 16, by suitable means for example by attaching other strips of the same material, so as to be capable of engaging or attracting the bottom of the magnets 16, and then thin longitudinal grooves 37 are provided on the sides of said strips 34 opposite the facings 13 to accommodate the bottom of the support members 28 of the magnets 16 by the strips 34 on the backing 10 continuing upwardly and forming channels 14 for the magnets 16 after allowing space for the free movement of the support members 28 in the channels 14. The parts of the channels 14 are peferably integral with the facings 13 so as to be capable of being raised with the top strips 12 to which the facings 13 are attached.

The sheets or other copy 19 remain conveniently on the backing 10 but to prevent possible bending over a top holder 18 is optionally provided. A flat piece 36, preferably rectangular and of magnetically attractable material such as sheet iron, is attached on the top part of the backing 10, preferably on an extended part of the cushioning 20 with a lower portion attached at the bottom of the firm covering 21. A magnet 37 is fastened on it with a short post 38 extending upward from the middle of said magnet 37. Movably on the post 38 is a magnet 39 with its bottom surface being of the opposite pole to the top of the magnet 37 fastened below, thereby being attracted to it. Attached to the bottom of said movable magnet 39 is a member 40 shaped so that its front end firmly engages the surface of the covering 21 on the backing 10. The front end of said member 40 may be provided with a rubber-like edging 41. Above the movable magnet 39 is another magnet 42, adjustably attached on the post 38, with its bottom surface having a magnetic pole the same as the top of the movable magnet 39 below, thereby repelling it and forcing it downward especially when it is raised. Said top magnet 42 is optionally attached by means of small tubing 43 mounted on it with side threading 44 to accommodate a set screw 45 against the post 38. While the bottom magnet 37 is preferable it may be dispensed with since the flat piece 36 is magnetically attractable.

A ledge may be provided at the bottom of the backing 10 and this may optionally be part of an easel 17. This may be one of the conventional or popular easels but preferably takes up little desk space and is adjustable. The easel 17, optionally provided, consists of a relatively flat extension 47 with its front end containing a ledge 46, or the front end of the extension 47 may be turned up to act as a ledge 46. An upright section 48, against which the top of the backing 10 rests, is fastened right angularly at the bottom to flat members 49 having a slot 50 into and through which the extension 47 passes permitting the upright section 48 to move forward or backward thus adjusting the tilting angle of the backing 10. Optionally the bottom members 49 contain a thumbed set screw 51 and nut 52 to hold the extension 47 in a set position. The bottom members 49 and the extension 47 are sufficiently wide and long for stability but may be increased or doubled and substantially all of the parts may preferably be dismantled. The easel 17 may be made of bent rod of metal or plastic and may be integral or in attached parts.

An enclosure cover 53 may optionally be provided consisting of a thin board 54 of any suitable material with fastening means such as magnetically attractable sections 55 near its four corners that register and adhere to magnets 56 on and near the ends of the extensions 11 or the reverse of this magnetic arrangement may be made. A handle 57 may be fastened by suitable means on the top of the backing 10 with a matching handle **57*a* on the side of the enclosure board 54** going against it.

The magnets 16 on the rod 15 may be set with their faces horizontally down on a flat strip instead of vertically against the facings 13 and they may be differently shaped. The rod 15 may optionally be translucent and may be luminous with interior or external suitable material and may be provided with illumination by a battery flashlight in the tubing.

The copyholder may be of different sizes and shapes to accommodate various copy 19 and the extensions 11 may be expandably movable with slotted extension members or by other suitable means.

OPERATION OF THE APPARATUS

FIG. 1 shows the fundamental operation of the device. The sheets or other copy 19 are inserted under the rod 15 by raising and lowering it. A flip of the fingers on the middle of the rod 15 moves or rolls it down and the rod 15 readily follows the lines being typed. It is found convenient and faster to let it follow every second or few lines. When the typing is interrupted the rod 15 maintains its position. Where line spacing is varied or different in the typewriter, as for commercial sheets, the rod 15 readily follows it manually without any mechanical adjustment.

The easel 17 is set at the desired angle with the thumb nut 52 turned down. The copy 19 retains its position under the rod's resilient tubing 27 or coating and with the ledge 46 and other members, but for special copy 19 or referring back a duplicate rod 15 can be provided.

The magnetic clamp 18, which can be doubled, does not leave marks by indenting the copy 19 and can be strengthened or weakened by the magnet spacing and is inexpensively durable.

The double magnets 16 on the support members 28 maintain the horizontal position of the rod 15 when it is being moved or rotated down. Magnets can also be set at the ends of the rod 15 without the ends being separately rotatable. Nuts 29 and bolts 30 are used to facilitate the slight rotatable spacing and the rest of the assembly but an unthreaded headed bar or the like with washers 31 can be used or, optionally without the springs 32, the inside of the tubular rod 15 may be threaded.

The cover 53 of the copyholder gives privacy to the user, and the top magnetic clamp is usable as a loose leaf binder. With the cover 53 the copyholder can be taken out overnight as a case.

I have described preferred embodiments of my invention but it is understood that various changes may be made in the form, details, arrangements and proportions of the various parts without departing from the scope of my invention.

What I claim is:

1. An apparatus for holding copy and following lines comprising a backing on which elongated side extensions are laterally mounted, said side extensions having walls toward the inside at right angles to the backing, the walls of the side extensions having facings of magnetically attractable material extending angulary outward at the bottom over said backing, a rod with magnetic end members sufficiently long and horizontally positioned so that its said end members adhere magnetically to said facings and to their angular extensions, said rod capable of being manually moved to follow lines on the copy and an adjustable easel on which the backing rests.

2. An apparatus for holding copy and following lines according to claim 1, said side extensions having mounted on them elongated strips to which the top of said facings are attached, said strips being capable of being raised with the facings.

3. An apparatus for holding copy and following lines according to claim 1, said rod containing a spring toward each end that helps propel said end members movably against the side extensions.

4. An apparatus for holding copy and following lines according to claim 1, said backing provided with a clamp comprising a base of magnetically attractable material, a magnet movably mounted above said base and magnetically attracted to it with an extension member attached to said magnet shaped so that its front end firmly bears on the copy, another magnet mounted above said magnet with its bottom surface having a magnetic pole the same as the top of said magnet thereby repelling said movable magnet and forcing it downward.

* * * * *